US005406243A

United States Patent [19]

Jenkins et al.

[11] Patent Number: 5,406,243

[45] Date of Patent: Apr. 11, 1995

[54] PACKS OF LAMINATIONS AND METHOD AND APPARATUS FOR FORMING THEM

[75] Inventors: Peter R. Jenkins, Cricklade; Trevor Hirst, Wootton Bassett, both of United Kingdom

[73] Assignee: Linton & Hirst Limited, Swindon, United Kingdom

[21] Appl. No.: 720,488

[22] Filed: Aug. 26, 1991

[30] Foreign Application Priority Data

Dec. 23, 1988 [GB] United Kingdom ..... 8830103

[51] Int. Cl.[6] ..... H01F 27/24

[52] U.S. Cl. ..... 336/217; 29/609; 29/738; 336/234

[58] Field of Search ..... 29/609, 605, 606, 738; 336/234, 216, 217, 213

[56] References Cited

U.S. PATENT DOCUMENTS 3,213,727 10/1965 Schwennesen .

FOREIGN PATENT DOCUMENTS 0133858 12/1958 European Pat. Off. .
0028494 10/1980 European Pat. Off. .
2150731 8/1972 France .
63-16607 1/1988 Japan .
616536 1/1949 United Kingdom .
680577 10/1952 United Kingdom .
1226538 3/1971 United Kingdom .
1529967 10/1978 United Kingdom .
1543567 4/1979 United Kingdom .
1581644 12/1980 United Kingdom .
2075273 11/1981 United Kingdom .

OTHER PUBLICATIONS

Patent Abstracts of Japan, vol. 6, No. 185 for Japanese Patent Publication No. 57-99718.
Patent Abstracts of Japan, vol. 12, No. 221 for Japanese Patent Publication No. 63-16607.

*Primary Examiner*—Carl E. Hall
*Attorney, Agent, or Firm*—Richard M. Goldberg

[57] ABSTRACT

Complementary packs of laminations (41, 43) are provided for use in an electromagnetic device, the laminations in different layers having legs of length that alternates according to a predetermined pattern. The lamination of one pack (41) can fit into the laminations of another pack (43) which has legs alternating according to a complementary pattern. The packs (41, 43) can be push-fitted together about a bobbin (45) to form an interleaved stack of laminations for a transformer or other electromagnetic device. A method and apparatus for forming the stacks are also described.

43 Claims, 4 Drawing Sheets

PACKS OF LAMINATIONS AND METHOD AND APPARATUS FOR FORMING THEM

The present invention relates to a pack of laminations for an electromagnetic device, to a method for making such a pack, to an apparatus for making the pack and to an electromagnetic device comprising the pack.

At present, laminations are interleaved into a wound transformer bobbin by hand or by means of a laminating machine. Hand assembly of the laminations into an interleaved stack is slow and costly. A laminating machine can operate at higher speeds but is expensive to buy and to maintain. If the machine is not correctly set and/or adjusted it can easily jam or damage the laminations, increasing assembly costs. Laminating machines are complex because of the task that they have to do, and those that form interleaved stacks from small or thin laminations are very delicate.

An object of the invention is to provide a way of enabling interleaved stacks of laminations to be assembled rapidly and inexpensively and without the need for complex machinery.

In one aspect the invention provides a pre-assembled pack of laminations for use in an electromagnetic device as one part of an interleaved stack of laminations, the laminations in different layers having legs of length that alternates.

In such a pack the laminations may all be of a single asymmetric outline and alternate by their orientation, or the laminations may alternate in outline. The legs of successive laminations may alternate, or groups of matching laminations (e.g. of 2 or 3 successive laminations) may alternate. Adjacent laminations may be attached together by adhesion but are preferably coupled together mechanically e.g. by push fit connectors. Thus the connection between each lamination and its neighbour is preferably established by projections on one face of the lamination projecting into depressions of the adjacent lamination. In such a structure, the depression and projection in each lamination may have generally cylindrical side surfaces, and may be as described in our patent specification No. GB-A-2206453. However, there will usually be more than one (e.g. two or three) such projections and depressions per lamination stack. The depth of the depression is preferably greater than 50% of the lamination thickness and the height of the projection is greater than 50% of the lamination thickness but less than the depth of the depression. In a particularly preferred connector structure, the depth of the depression is about 69% of the lamination thickness and the height of the projection is about 65% of the lamination thickness. The packs may additionally include partitioning plates. In one form of the pack, the laminations are E-laminations, the laminations being of a single outline whose side legs differ in length. In another form, the laminations are E-laminations, the laminations being of two different outlines each having side legs of the same length but the length of the side legs in one shape differing from the length of the side legs in the other shape. In a third form, the laminations are alternating T- and C-laminations.

In another aspect, the invention comprises a method for making a pre-formed pack of laminations of preselected size to act as one part of an interleaved stack of laminations for use in an electromagnetic device, the method comprising placing the laminations one onto the other so that the legs of different laminations alternate in length, and attaching the laminations together.

In the above method, each lamination may be attached to the adjacent lamination as it is placed onto it. Each lamination may be attached to its adjacent lamination using at least one projection on one side of the lamination that projects into at least one depression on the other side of an adjacent lamination. For convenient and rapid attachment, there is formed in a strip from which the laminations are to be cut on a common axis perpendicular to the strip projections on one side thereof and depressions on the other side thereof, after which laminations of differing outline are cut from the strip with each lamination having at least one projection and depression and each lamination is attached to an adjacent lamination by inserting the or each projection on one side of the lamination into the or each depression on the other side or the adjacent lamination. A preferred method that simultaneously forms two pairs of complementary packs comprises simultaneously cutting portions of the strip as it advances into pairs of complementary opposite facing laminations with the locations of severance lines between outer legs of the laminations of each pair being altered to provide an alternation in the length of the legs, the oppositely facing laminations being cut from the strip at successive positions along the advancing strip and being attached to form packs of oppositely facing laminations that are interfittable to define an interleaved stack.

The invention further provides a pack of laminations for use in an electromagnetic device, the laminations in different layers having legs of length that alternates according to a predetermined pattern so that the laminations can fit into the laminations of another pack of laminations having legs alternating according to a complementary pattern to form an interleaved stack of laminations.

The invention further provides a method of making a stack of laminations, which comprises interleaving and sliding together two complementary packs of laminations as aforesaid. Thus where the stack is to be assembled to a transformer bobbin, the pre-assembled packs are offered to the bobbin from opposite ends thereof, their legs are inter-engaged, the packs are pushed together to complete the stack and the stack is then locked together e.g. as described in our patent application No. 8817875.1.

The alternation of a progression tool so that laminations of different outline can be stamped out while the press is running believed to be new. In a further aspect the invention provides apparatus for cutting laminations for use in an electromagnetic device comprising progression tool means actuatable by a press to cut the laminations and means for altering the tool means between first and second cutting conditions to alter the outline of the laminations cut in successive strokes of the tool.

In such apparatus the progression tool means may be arranged to cut pairs of oppositely facing laminations and cutting means for cutting a boundary between the laminations of each pair is alterable between first and second conditions in which it cuts different boundaries in successive pairs or groups of pairs of laminations.

In a yet further aspect the invention provides apparatus for forming packs of laminations for use in an electromagnetic device as one part of an interleaved stack of laminations, comprising:

means for forming cuts at different places along the strip to define positions of severance between legs of an adjacent pair of oppositely facing laminations;

means for forming on the strip on common axes perpendicular to the strip depressions on one side thereof and projections on the other side thereof;

means for varying the locations of the lines of severance so that the pairs of oppositely facing laminations at different positions along the strip differ in leg length;

means for cutting the oppositely facing laminations from the strip;

means for assembling the cut laminations into a pair of oppositely facing packs of laminations; and means for coupling each lamination to its adjacent lamination by inserting the or each projection on one side thereof into the or each depression on the other side of an adjacent lamination.

In such apparatus cutters conveniently occur in pairs spaced apart along or transversely of the strip, and means causes one cutter of each pair to operate whilst the other cutter is removed from operation so as to define alternate positions of the lines of severance of legs of adjacent laminations.

Various embodiments of the invention will now be described, by way of example only, with reference to the accompanying drawings, in which.

Figure 5A:
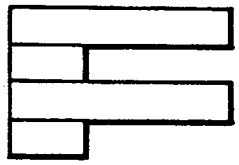

FIG. 5*a* is a side view of a singly interleaved lamination pack and

Figure 5B:
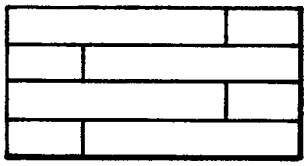

FIG. 5*b* is a side view of an interleaved stack formed by push fitting together two of the packs of FIG. 5*a;*

Figure 6A:
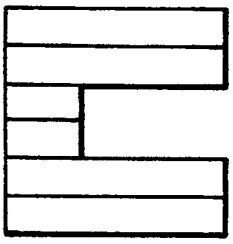

FIG. 6*a* is a side view of a multiply interleaved lamination pack and

Figure 6B:
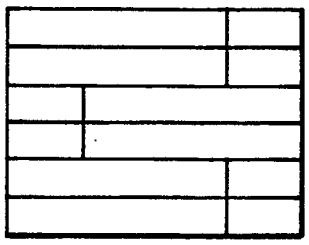
Figure 7:
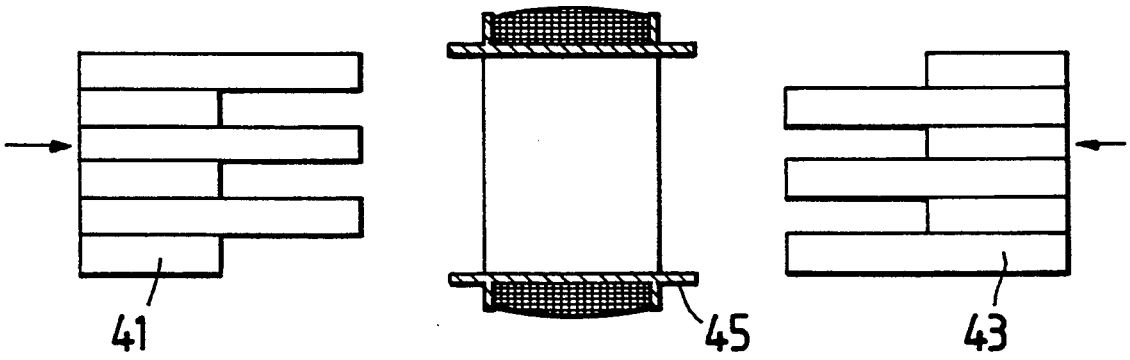
Figure 8:
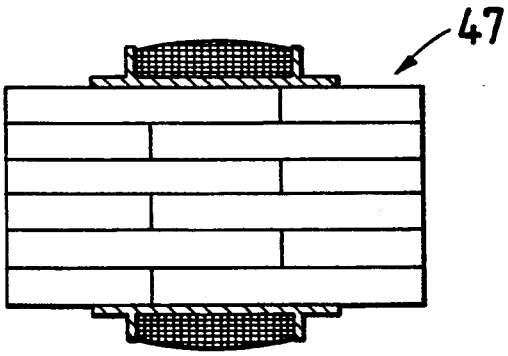
Figure 9:
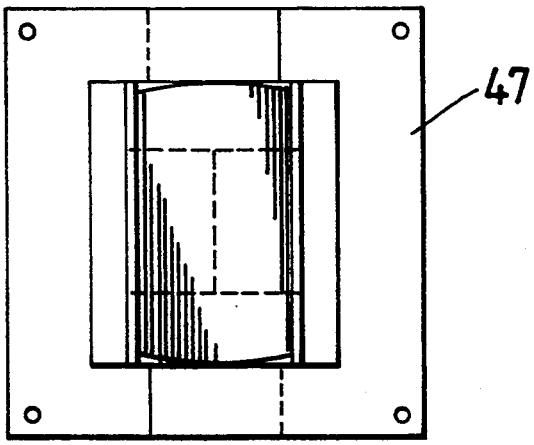
Figure 10A:
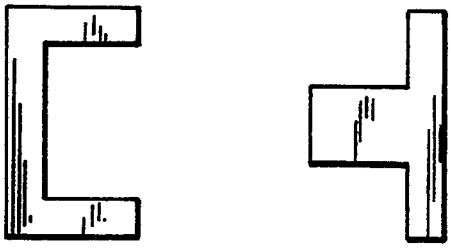
Figure 10B:
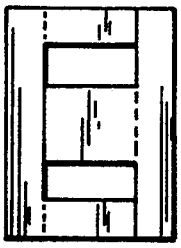

FIG. 6*b* is a side view of an interleaved stack formed by push fitting together two of the packs of FIG. 6;

FIG. 7 shows diagrammatically the assembly of a bobbin and two lamination packs to make a transformer, and FIGS. 8 and 9 are a section and an elevation of the resulting transformer; and FIGS. 10*a*–13*a* show the outlines of laminations that may be formed into pre-formed packs of alternating laminations and FIGS. 10*b*–13*b* show in plan the interleaved stacks each resulting from assembly of two packs according to a respective one of FIGS. 10*a*–13*a.*

In the drawings there is shown a method of manufacturing pre-formed packs of laminations locked together in interleaved form. Two or more of the packs may be assembled together to form the core of an electromagnetic device e.g. a transformer, choke or motor. Each pack is separated from an adjacent pack by a partitioning plate. The packs of laminations are connected together one to another by inter-engaged projections and depressions. The partitioning plate is connected by engagement of pegs of an overlying lamination into a through hole thereof, and the packs must be able to withstand the stresses applied by the subsequent production processes, including high temperture heat treatment and must still be capable of interfitting one with another to form the desired interleaved stack.

In FIGS. 1–5 a series of laminations 10 and a partitioning plate 12 are stamped in pairs facing one another from a metal strip 14 in a series of stages 1–5. If necessary the number of stages can be increased e.g. because of tool pilots not shown in layout.

Stamping is carried out using a high speed progression tool with stations in the tool for carrying out the necessary forming stages. The tool comprises a male punch assembly and a female die assembly secured in an automatic power press generally as described in our patent application No. GB-A-2206453, with reference to FIGS. 9A–9D.

Figure 11A:
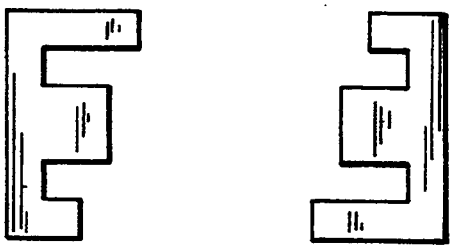
Figure 11B:
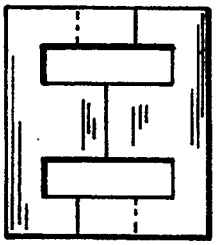

At stage 1 slots are punched that are directed transversely of the strip 14 to define the ends of the lamination legs of each pair. A slot 16 defining the length of a middle leg in this embodiment does not change position, but slots 18*a,* 19*a* defining the lengths of the side legs at positions A alternate with slots 18*b,* 19*b,* at position B. For this purpose, blade punches occur in pairs overlying either side of the strip 11, one pair corresponding to slots 18*a,* 18*b* and the other pair corresponding to slots 19*a,* 19*b.* Operation of each pair of blade punches or rods 20*a,* 20*b* is controlled through a common cam bar 22 having lobes 24*a,* 24*b* spaced apart and positioned relative to the rods 20*a,* 20*b* so that one of them is in an extended position causing its associated blade punch to operate and the other of them is retracted causing its associated blade punch to be idle. Reciprocation of the cam bar 22 for each of the blade punches at 18*a,* 18*b* and 19*a,* 19*b* causes alternation of the locations of cutting between the positions marked A and the positions marked B, and a corresponding alternation in the length of the legs of the laminations formed. Control of the blade punches via cam bars 22 provides a simple and effective method of bringing about alternation in the outline of the pair of laminations being cut out. Means is provided for changing the position of the cam bars according to the strokes of the power press. Thus the bars 22 may be moved as required by an electro-pneumatic arrangement (not shown). If the cam bars 22 are moved at every stroke of the press single interleaved packs are produced (FIGS. 5, 5*a*); if they are altered at every two strokes then the packs are double interleaved (FIGS. 6, 6*a*) and if they are altered after more than two strokes the packs are multiple interleaved. The use of multiple interleaved packs is advantageous where the material thickness of the individual laminations is thin e.g. about 0.1 mm–0.25 mm. Interleaved packs of such thin laminations were previously difficult to make. The pattern of operation of the bars 22 could, if desired, be altered according to a more complex pattern, so that a pack could be multiply interleaved at its ends and singly interleaved in the middle or vice versa, and control means could arrange for this pattern to be produced automatically in each stack. One form of the resulting pattern of laminations is shown at FIGS. 11*a,* 11*b.*

Figure 1:
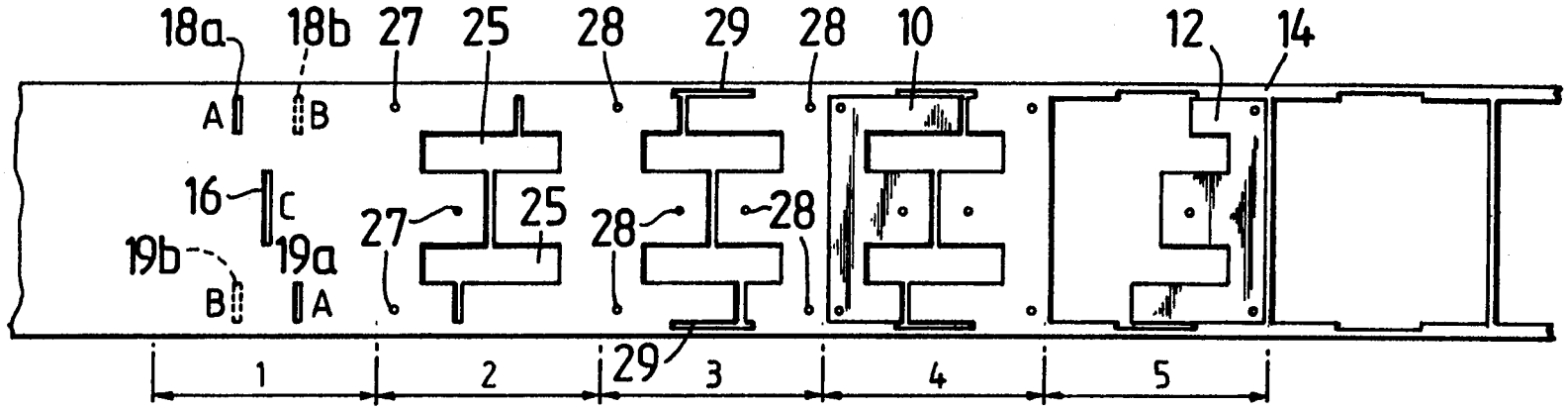
FIG. 1 shows a strip of ferromagnetic material having laminations punched from it as it passes stepwise through a progression tool.
Figure 3:
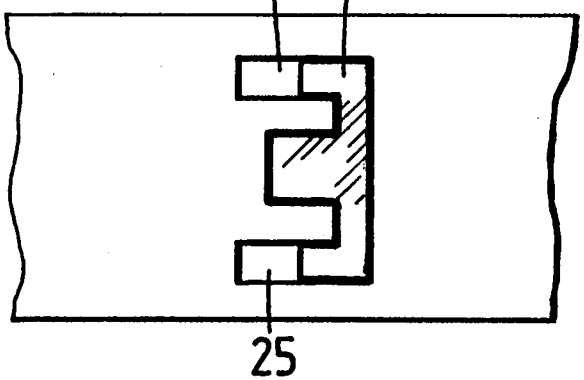
FIG. 3 is a partial plan of the apparatus with outlines of a punch and die superimposed.
Figure 2:
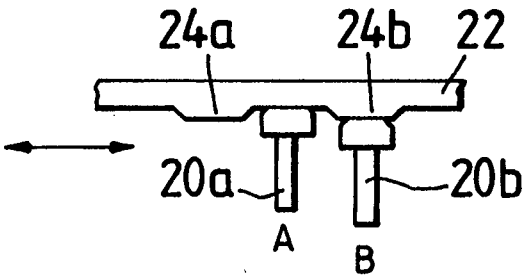
FIG. 2 shows blade punches and a cam forming part of a male punch assembly for forming the laminations.
Figure 4:
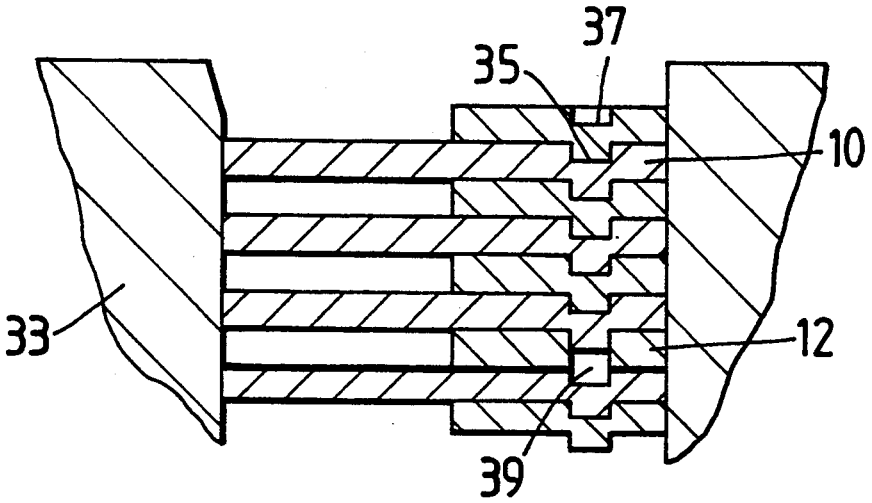
FIG. 4 is an enlarged partial view of a female die assembly showing interleaved and locked lamination packs with a partitioning plate that separates adjacent packs.

At stage 2, apertures or windows 25 defining spaces between the legs of the laminations are punched in the strip 14 and in the case of laminations to form end plate separators, which separate the adjacent packs and occur at intervals, through holes 27 are punched out of the strip by co-operating punches and dies. The holes 27 occur in a region of the strip to form one only of the pair of laminations. Operation of the punches to form the holes 27 is controlled by means of cam bars like the rods and bar 22 and also actuated by an electro-pneumatic arrangement (not shown). The stack height is controlled electronically, the strip 14 being measured prior to stamping and the number of laminations to give the required stack height being computed. When the stack is in its tolerance band an end plate 12 is formed that separates the lamination stacks. At stage 3, blade punches directed parallel to the strip form leg slits 29 adjacent to the edges of the strip and at the same time coaxial projections and depressions 35, 37 (FIG. 4) are formed in the strip 14 at locations 28. The section of the projections and depressions may be as described in our patent specification No. GB-A-2206453. At stage 4 a first set of the E-laminations is stamped out of the strip 14 by an E-shaped punch 31 which co-operates with die 33 (FIGS. 3 and 4). At the same time as the laminations 10 and end plates 12 are punched out, they are stacked one upon the other with the projections 35 of each lamination projecting into the corresponding depressions 37 of the adjacent lamination. For that purpose, the punch 31 is additionally provided with thrust rods (not shown) coaxial with the projections and depressions at locations 28. The interference fit of the projections 35 into the depressions 37 (or in the case of an end plate 12 in the through-holes 39) necessitates the pressure being applied through punch 31 and the thrust rods being countered by a similar counter pressure developed progressively in the die 33 and by restrictor blocks and a restrictor tube (not shown) beneath the die 33 as described in our patent specification No. GB-A-2206453. Because the apertures 25 had been formed at step 2, the same punch outline serves to punch out both long and short lamination legs. At stage 5 a second E-lamination is stamped out into a second die and attached to another set of laminations to form an oppositely facing interleaved stack that is complementary to the stack being formed at stage 4.

In FIG. 7, pre-formed interleaved stacks of laminations 41, 43 are offered to a bobbin 45 of a transformer or other device and the limbs of the laminations are interfitted, after which the stacks 41, 43 can be pushed fully together to form an interleaved lamination pack 47 (FIGS. 8, 9).

Figure 12A:
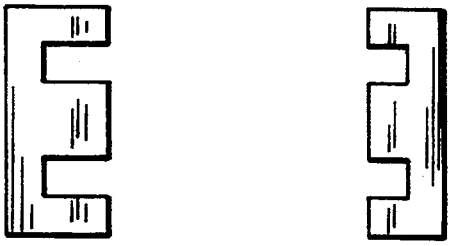
Figure 12B:
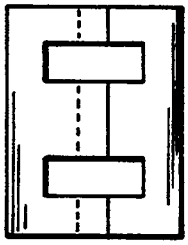
Figure 13A:
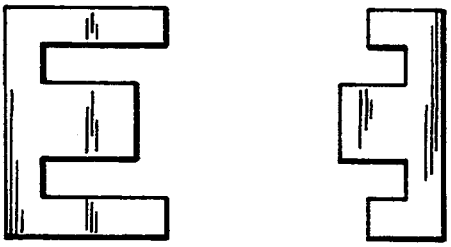
Figure 13B:
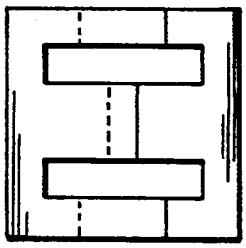

In a modification, the cam rods 22 may be directed transversely of the strip 14 to operate blade punches at positions A and B. With this arrangement both outer limbs of a lamination alternate in length at the same time, the laminations altering in outline rather than orientation (FIGS. 12*a*, 12*b*). Provision of three pairs of blade punches, one located centrally of the strip and the others located to the sides of the strip enables alternating T- and C- laminations to be formed (FIGS. 10*a*, 10*b*) or E-laminations in which the length of the central limb alternates as well as the length of the side limbs (FIGS. 13*a*, 13*c*). In a further modification, the laminations could be locked together by interfitting depressions and projections of generally rectangular outline instead of the cylindrical projections and depressions 35, 37.

We claim:

1. A pack of laminations for use in an electromagnetic device as one part of an interleaved stack of laminations, said laminations being formed in layers in said pack, each said lamination having at least one leg, and the laminations being arranged in a plurality of first sets of at least one lamination and a plurality of second sets of at least one lamination, the first and second sets alternating with each other in said pack, an open air gap being provided between the legs of the laminations of successive first sets, each said lamination having at least one projection and at least one depression, and each lamination being coupled to an adjacent lamination by at least one said projection thereon projecting into at least one said depression of the adjacent lamination.

2. A pack of laminations according to claim 1, wherein the laminations are all of a single asymmetric outline, the laminations in said first set have one orientation, and the laminations in said second set have a different orientation, so that the laminations alternate in orientation.

3. A pack of laminations according to claim 2, wherein the laminations are E-laminations, the laminations being of a single outline having side legs which differ in length.

4. A pack of laminations according to claim 1, wherein the laminations in said first set have a first outline, and the laminations in said second set have a different second outline, so that the laminations in the first and second sets alternate in outline.

5. A pack of laminations according to claim 4, wherein the laminations of the first and second sets are E-laminations, the laminations of the first set being of a first outline having side legs of the same length, the laminations of the second set being of a second outline having side legs of the same length, and the side legs of the first outline having a length which is different from the length of the side legs of the second outline.

6. A pack of laminations according to claim 5, wherein the laminations of the first and second sets of E-laminations each have an inner leg, and the inner leg of the laminations of the first set having a length which is different from the length of the inner leg of the laminations of the second set.

7. A pack of laminations according to claim 4, wherein the laminations of the first set are C-laminations and the laminations of the second set are T-laminations.

8. A pack of laminations according to claim 1, wherein each said first and second set of laminations includes only one lamination.

9. A pack of laminations according to claim 1, wherein each said first and second set of laminations includes at least two laminations.

10. A pack of laminations according to claim 1, wherein said at least one projection and at least one depression in each lamination have generally cylindrical side surfaces.

11. A pack of laminations according to claim 10, wherein:

each said lamination has a thickness, each said depression has a depth which is greater than 50% of the lamination thickness, and each said projection has a height which is greater than 50% of the lamination thickness but less than the depth of a corresponding said depression.

12. A pack of laminations according to claim 11, wherein the depth of each said depression is about 69% of the lamination thickness and the height of each said projection is about 65% of the lamination thickness.

13. A pack of laminations according to claim 1, further including a partitioning plate for securement to a lowermost lamination of the pack for separating adjacent packs of laminations.

14. A pack of laminations according to claim 1, wherein each said lamination has a thickness in the range of about 0.1 mm to 0.25 mm.

15. A pack of laminations according to claim 1, wherein the laminations of said pack are arranged according to a predetermined pattern for receiving laminations of a complementary said pack of laminations, with legs of said laminations of said complementary pack fitting into said open air gaps of the first-mentioned pack to form an interleaved stack of laminations.

16. A method for making a pack of laminations for use in an electromagnetic device as one part of an interleaved stack of laminations, the method comprising the steps of:

cutting the laminations from an advancing strip such that each said lamination has at least one leg, placing the laminations one onto the other in layers as said laminations are cut from said strip, including the step of arranging the laminations in a plurality of first sets of at least one lamination and a plurality of second sets of at least one lamination, with the first and second sets alternating with each other in said pack and an open air gap being provided between the legs of the laminations of successive first sets, and securing each lamination to an adjacent lamination when each lamination is placed onto the adjacent lamination.

17. A method according to claim 16, further including the step of forming at least one projection and at least one depression in each said lamination, and said step of securing includes the step of attaching each said lamination to an adjacent lamination by at least one projection thereof projecting into at least one depression of the adjacent lamination.

18. A method according to claim 17, wherein said step of forming includes the step of forming each said projection and depression in each lamination with generally cylindrical side surfaces.

19. A method according to claim 18, wherein each said lamination has a thickness, and said step of forming includes the step of forming each said depression with a depth which is greater than 50% of the lamination thickness, and each said projection with a height which is greater than 50% of the lamination thickness but less than the depth of a corresponding said depression.

20. A method according to claim 19, wherein the depth of each said depression is about 69% of the lamination thickness and the height of each said projection is about 65% of the lamination thickness.

21. A method according to claim 16, wherein said step of cutting includes the step of cutting the laminations from the advancing strip such that each said lamination has at least one projection on one side thereof and at least one depression on an opposite side thereof, with each projection being formed in a direction perpendicular to a plane of said strip on a common axis with a corresponding said depression.

22. A method according to claim 16, further comprising the step of forming two said packs of laminations which are interfittable with each other to form an interleaved stack, said step of forming said two packs including the step of cutting portions of the strip at successive positions therealong into pairs of complementary opposite facing laminations with locations of severance lines between outer legs of the laminations of each pair being altered to provide an alternation in the length of the outer legs of each said pair.

23. A method according to claim 22, wherein said step of cutting includes the step of cutting complementary pairs of laminations of a T-outline and a C-outline.

24. A method according to claim 22, wherein said step of cutting includes the step of cutting complementary pairs of laminations of an E-outline.

25. A method according to claim 16, further comprising the step of forming two said packs of laminations which are interfittable with each other to form an interleaved stack, said step of forming said two packs including the step of cutting portions of the strip at successive positions therealong into pairs of complementary opposite facing laminations with locations of severance lines between inner legs of the laminations of each pair being altered to provide an alternation in the length of the inner legs of each said pair.

26. A method according to claim 25, wherein said step of cutting includes the step of cutting complementary pairs of laminations of a T-outline and a C-outline.

27. A method according to claim 25, wherein said step of cutting includes the step of cutting complementary pairs of laminations of an E-outline.

28. A method according to claim 25, wherein said step of cutting includes the step of cutting complementary pairs of laminations of an E-outline having inner and outer legs, such that locations of severance lines between the inner and outer legs of the E-outline laminations of each pair are altered to provide an alternation in the length of the inner and outer legs of the E-laminations of each said pair.

29. A method according to claim 16, wherein said step of cutting includes the steps of:

interposing said strip between a male punch and a female die, and operating said punch to cut each of said laminations from said strip such that each lamination is deposited in a recess in said die on top of any previously formed laminations so as to form said pack in said die, said recess being shaped to accommodate each alternative outline of said laminations.

30. A method according to claim 16, wherein said step of cutting includes the step of cutting all of the laminations in a single asymmetric outline, with the laminations in said first set have one orientation, and the laminations in said second set have a different orientation, so that the laminations alternate in orientation.

31. A method according to claim 16, wherein said step of cutting includes the step of cutting laminations in said first set with a first outline, and laminations in said second set with a different second outline, so that the laminations in said first and second sets alternate in outline.

32. A method according to claim 16, wherein said step of arranging the laminations includes the step of arranging one lamination in each of said first and second sets.

33. A method according to claim 16, wherein said step of arranging the laminations includes the step of arranging two laminations in each of said first and second sets.

34. A method according to claim 16, further including the step of forming a partitioning plate for securement to a lowermost lamination of the pack for separating adjacent packs of laminations.

35. A method according to claim 16, wherein each said lamination has a thickness in the range of about 0.1 mm to 0.25 mm.

36. Apparatus for forming a pack of laminations for use in an electromagnetic device, comprising:

progression tool means actuatable by a press to cut the laminations from an advancing strip, such that each said lamination has at least one leg, means for altering the tool means between first and second cutting conditions to alter at least one of the outline and orientation of the laminations cut in successive strokes of the tool, means for placing the laminations one onto the other in layers as said laminations are cut from said strip, such that the laminations are arranged in a plurality of first sets of at least one lamination and a plurality of second sets of at least one lamination, with the first and second sets alternating with each other in said pack and an open air gap being provided between the legs of the laminations of successive first sets, and means for securing each lamination to an adjacent lamination when each lamination is placed onto the adjacent lamination.

37. Apparatus according to claim 36, further comprising means for forming in each lamination at least one projection on one face and at least one complementary depression on an opposite face such that adjacent laminations can be attached to each other by insertion of the projection of one lamination into the depression of another lamination.

38. Apparatus according to claim 36, wherein the progression tool means is arranged to cut pairs of oppositely facing laminations, and comprises cutting means for cutting a boundary between the laminations of each pair which is alterable between first and second conditions such that said cutting means cuts different boundaries in successive pairs of laminations.

39. Apparatus according to claim 36, wherein said cutting means comprises:

a cam bar having at least one lobe formed thereon, said cam bar being movable between a first position and a second position corresponding to said first and second conditions of said cutting means, respectively; and two blade means spaced apart along said cam bar, such that one of said blade means is displaced by said lobe to an operative position in which it is operable to cut said boundary and the other blade means is displaced to an inoperative position in which it is not operable to cut said boundary, the blade means which is operable to cut said boundary altering according to movement of said cam bar between said first position and said second position.

40. Apparatus according to claim 36, wherein said progression tool means comprises a punch, and said apparatus further comprises a die with which said punch cooperates to deposit the laminations formed by the tool means when in said first cutting condition in said die and to press them together to form said pack.

41. Apparatus for forming two packs of laminations for use in an electromagnetic device which are interfittable to form an interleaved stack of laminations, comprising:

means for forming cuts at different locations of a strip to define positions of severance between legs of an adjacent pair of oppositely facing laminations;

means for varying the locations of the lines of severance so that the pairs of oppositely facing laminations at different positions along the strip differ in leg length;

means for cutting the pairs of oppositely facing laminations from the strip; and means for assembling the cut laminations into a pair of packs including:

means for placing the laminations one onto the other in layers in each pack as said laminations are cut from said strip, such that the laminations in each pack are arranged in a plurality of first sets of at least one lamination and a plurality of second sets of at least one lamination, with the first and second sets alternating with each other in said pack and an open air gap being provided between the legs of the laminations of successive first sets, and means for securing each lamination to an adjacent lamination in each pack when each lamination is placed onto the adjacent lamination.

42. Apparatus according to claim 41, further comprising means for forming in each lamination at least one projection on one face and at least one complementary depression on an opposite face such that adjacent laminations can be attached to each other by insertion of the projection of one lamination into the depression of another lamination.

43. Apparatus according to claim 41, wherein said means for forming cuts includes a pair of cutters spaced along the strip, and means for causing one cutter to operate and for removing the other cutter from operation so as to define alternate positions of the lines of severance of legs of adjacent laminations.

* * * * *